US009488006B2

(12) United States Patent
Forstner et al.

(10) Patent No.: US 9,488,006 B2
(45) Date of Patent: Nov. 8, 2016

(54) DOWNHOLE DEPTH MEASUREMENT USING TILTED RIBS

(71) Applicants: Ingo Forstner, Ahnsbeck (DE); Christian Herbig, Nienhagen (DE)

(72) Inventors: Ingo Forstner, Ahnsbeck (DE); Christian Herbig, Nienhagen (DE)

(73) Assignee: Baker Hughes Incorporated, Houston, TX (US)

( * ) Notice: Subject to any disclaimer, the term of this patent is extended or adjusted under 35 U.S.C. 154(b) by 450 days.

(21) Appl. No.: 14/180,506

(22) Filed: Feb. 14, 2014

(65) Prior Publication Data

US 2015/0233182 A1 Aug. 20, 2015

(51) Int. Cl.

| | |
|---|---|
| ***E21B 47/024*** | (2006.01) |
| ***E21B 7/06*** | (2006.01) |
| ***E21B 47/00*** | (2012.01) |
| ***E21B 47/04*** | (2012.01) |
| ***E21B 17/10*** | (2006.01) |

(52) U.S. Cl.

CPC ..... *E21B 7/062* (2013.01); *E21B 17/1014* (2013.01); *E21B 47/0002* (2013.01); *E21B 47/024* (2013.01); *E21B 47/04* (2013.01)

(58) Field of Classification Search

CPC .. E21B 47/04; E21B 47/0002; E21B 47/024; E21B 17/1014; E21B 7/062

See application file for complete search history.

(56) References Cited

U.S. PATENT DOCUMENTS

| | | | | |
|---|---|---|---|---|
| 2,166,212 A | | 7/1939 | Hayward | |
| 2,671,346 A | | 3/1954 | Banning, Jr. | |
| 2,696,367 A | * | 12/1954 | Robishaw | E21B 17/07 175/295 |
| 2,973,996 A | * | 3/1961 | Self | E21B 17/1078 175/323 |
| 3,156,310 A | * | 11/1964 | Frisby | E21B 7/062 175/325.2 |
| 3,205,733 A | * | 9/1965 | Shiplet | E21B 17/16 76/108.1 |
| 3,447,839 A | * | 6/1969 | Salvatori | E21B 17/1078 175/325.2 |
| 3,675,728 A | * | 7/1972 | Faulk | E21B 17/1078 175/325.5 |
| 4,179,817 A | | 12/1979 | Lavigne et al. | |
| 4,592,257 A | | 6/1986 | Durr | |
| 4,844,161 A | | 7/1989 | Rankin et al. | |
| 5,220,963 A | | 6/1993 | Patton | |
| 5,469,916 A | | 11/1995 | Sas-Jaworsky et al. | |
| 5,705,812 A | | 1/1998 | Brewer et al. | |
| 6,272,434 B1 | | 8/2001 | Wisler et al. | |
| 6,564,883 B2 | | 5/2003 | Fredericks et al. | |

(Continued)

FOREIGN PATENT DOCUMENTS

| | | |
|---|---|---|
| CN | 202372117 | 8/2012 |
| WO | 9312318 | 6/1993 |

(Continued)

OTHER PUBLICATIONS

PCT International Search Report and Written Opinion; International Application No. PCT/US2015/015446; International Filing Date: Feb. 11, 2015; Date of Mailing: May 27, 2015; pp. 1-15.

*Primary Examiner* — Robert E Fuller
*Assistant Examiner* — David Carroll
(74) *Attorney, Agent, or Firm* — Cantor Colburn LLP

(57) ABSTRACT

A system, method and apparatus for using a tool in a borehole is disclosed. The tool is disposed in the borehole. The tool includes a member rotatable substantially independently of the tool. The member is slidably coupled to a wall of the borehole. The tool is conveyed through the borehole to produce a rotation of the member as a result of the slidable coupling between the member and the wall of the borehole. A parameter of axial motion is determined from an angle of rotation of the member.

20 Claims, 5 Drawing Sheets

(56) References Cited

U.S. PATENT DOCUMENTS

| | | | | |
|---|---|---|---|---|
| 7,044,238 | B2 | 5/2006 | Hutchinson | |
| 7,047,653 | B2 | 5/2006 | Fitzgerald | |
| 7,912,647 | B2 | 3/2011 | DiFoggio | |
| 8,040,755 | B2 | 10/2011 | Priest | |
| 8,433,517 | B2 | 4/2013 | Ekseth et al. | |
| 8,439,109 | B2 | 5/2013 | Sbordone | |
| 2002/0130663 | A1 | 9/2002 | Kuckes et al. | |
| 2003/0233894 | A1* | 12/2003 | Tezuka | E21B 47/024 73/865.8 |
| 2005/0199425 | A1 | 9/2005 | Estes et al. | |
| 2007/0107937 | A1* | 5/2007 | Sugiura | E21B 7/062 175/45 |
| 2011/0290011 | A1 | 12/2011 | Dowla et al. | |
| 2012/0145384 | A1 | 6/2012 | Chang et al. | |

FOREIGN PATENT DOCUMENTS

| | | | |
|---|---|---|---|
| WO | 0120129 | A2 | 3/2001 |
| WO | 03021278 | A2 | 3/2013 |

* cited by examiner

700

| | | | | |
|---|---|---|---|---|
| | **Scenario #1** | | | |
| 702 | Hole diameter | 12.25 | [in] | 0.31115 | [m] |
| | Hole circumference | 38.48451 | [in] | 0.977507 | [m] |
| 704 | Tilt angle | 45 | [°] | 0.785398 | [rad] |
| | MD for one rotation | 3.207043 | [ft] | 0.977507 | [m] |
| | ROP | 65.6168 | [ft/h] | 20 | [m/h] |
| | Time needed for one rotation | 2.93252 | [min/rot] | 0.048875 | [h/rotation] |
| | Resolution of sensor | 0.5 | [°] | 0.008727 | [rad] |
| | ~MD resolution | 0.427606 | [in] | 0.010861 | [m] |
| | ~update frequency | 0.032584 | [min] | 0.000543 | [h] |
| | Slippage per time | 6 | [°/min] | 1 | [rotations/h] |
| | Slippage per depth | 0.984252 | [°/ft] | 0.05 | [rotations/m] |
| 706 | Percent slippage error | 4.89% | [-] | 4.89% | [-] |
| | Hole overgauge | 0.125 | [-] | 1.02% | [-] |
| | Percent hole overgauge error | 1.02% | [-] | 1.02% | [-] |

FIG. 7

800

| | | | | |
|---|---|---|---|---|
| | **Scenario #2** | | | |
| 802 | Hole diameter | 4.75 | [in] | 0.12065 | [m] |
| | Hole circumference | 14.92257 | [in] | 0.379033 | [m] |
| 804 | Tilt angle | 30 | [°] | 0.523599 | [rad] |
| | MD for one rotation | 2.153887 | [ft] | 0.656505 | [m] |
| | ROP | 16.4042 | [ft/h] | 5 | [m/h] |
| | Time needed for one rotation | 7.878056 | [min/rot] | 0.131301 | [h/rotation] |
| | Resolution of sensor | 1 | [°] | 0.017453 | [rad] |
| | ~MD resolution | 0.861555 | [in] | 0.021883 | [m] |
| | ~update frequency | 0.262602 | [min] | 0.004377 | [h] |
| | Slippage per time | 12 | [°/min] | 2 | [rotations/h] |
| | Slippage per depth | 7.874016 | [°/ft] | 0.4 | [rotations/m] |
| 806 | Percent slippage error | 26.26% | [-] | 26.26% | [-] |
| | Hole overgauge | 0.250 | [-] | 5.26% | [-] |
| | Percent hole overgauge error | 5.26% | [-] | 5.26% | [-] |

FIG. 8

DOWNHOLE DEPTH MEASUREMENT USING TILTED RIBS

BACKGROUND OF THE DISCLOSURE

1. Field of the Disclosure

The present disclosure relates to measuring a parameter of motion of a tool in a borehole and, in particular, to determining the parameter of axial motion from an angle of rotation of a freely-rotating member of a tool conveyed in the borehole.

2. Description of the Related Art

Petroleum exploration generally involves drilling a borehole into a formation or reservoir using a drill string with a drill bit at a bottom end of the drill string. The borehole may be a vertical borehole drilled to a selected depth or, in some cases, an inclined or horizontally drilled borehole within the reservoir. In order to construct a borehole to the selected depth, it is necessary to determine a distance and/or distance-related parameters within the borehole. Such distance parameters may include, for example, measured depth, rate of penetration, build-up rate, hole curvature, etc. Current methods of measured depth determination are using surface measurements, such as those involving a combination of cumulative pipe lengths and a top drive position. The wellbore geometry then is calculated from the hole direction at several certain depth, as measured downhole, which may include gravitometers and magnetometers. Using these methods, the measured depth and the wellbore geometry is derived on surface rather than downhole. Alternatively, gyroscopes may be used the measure three-dimensional movement and hence position. These measurements each include an amount of error both in their measurements and the processing of their measurements to obtain parameters of motion. The methods disclosed herein provide a method of determining a parameter of axial motion by correlating a rotation of a member of the drill string with distance traveled in the borehole.

SUMMARY OF THE DISCLOSURE

In one aspect, the present disclosure provides a method of using a tool in a borehole, including: disposing the tool in the borehole, the tool including a member rotatable substantially independently of the tool; coupling the member to a wall of the borehole; conveying the tool through the borehole to produce a rotation of the member as a result of the coupling between the member and the wall of the borehole; determining a parameter of axial motion of the tool through the borehole from an angle of rotation of the member; and using the tool based on the determined parameter of axial motion.

In another aspect, the present disclosure provides a system for drilling a formation, including: a drill string; a member of the drill string configured to rotate substantially independently of the drill string, wherein the member is configured to couple to a wall of a borehole in the formation; and a processor configured to: determine an angle of rotation of member produced by coupling of the member to the wall of the borehole as the drill string travels through the borehole, determine a parameter of axial motion of the drill string from the determined angle of rotation, and use the determined parameter of axial motion of the drill string to alter a drilling parameter of the drill string.

In yet another aspect, the present disclosure provides an apparatus for use in a borehole, the apparatus including: a member configured to be conveyed in a borehole on a tool and to rotate substantially independently of the tool, wherein the member is slidably coupled to a wall of the borehole; and a processor configured to: determine an angle of rotation of the member produced by coupling of the rib with the wall of the borehole and an axial motion of the tool string through the borehole, and determine a parameter of axial motion of the tool string from the determined angle of rotation.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein:

FIGS. 7 and 8 show tables illustrating estimates of error margins that occur when determining a parameter of axial motion using the methods and apparatus disclosed herein.

DETAILED DESCRIPTION OF THE DISCLOSURE

Figure 1:
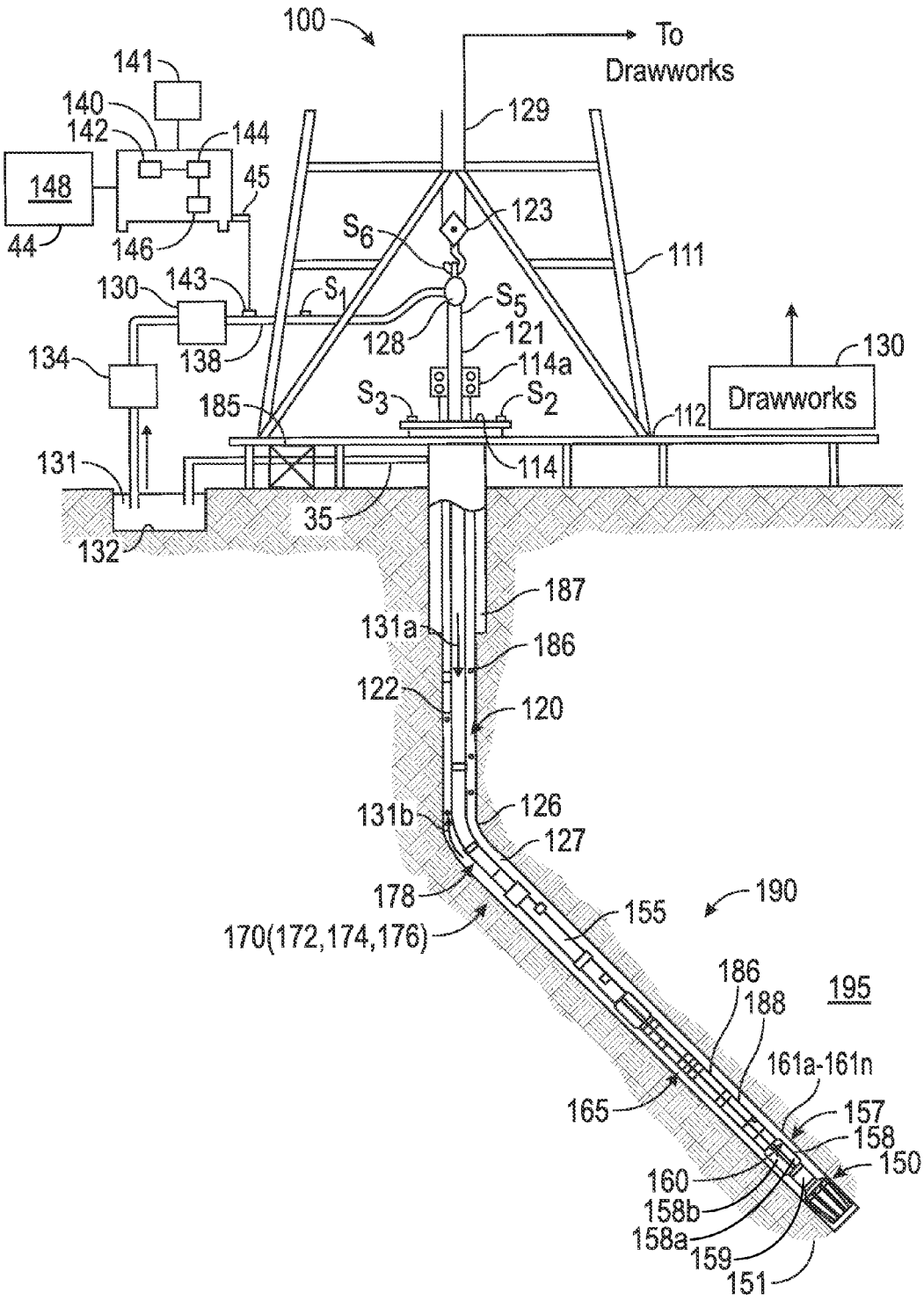
FIG. 1 is a schematic diagram of an exemplary drilling system that includes a drill string having a drilling assembly attached to its bottom end that includes a steering unit according to one embodiment of the disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottomhole assembly ("BHA") 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190 attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Tubing injection speed is determined from the sensor $S_5$, while the sensor $S_6$ provides the hook load of the drill string 120.

In some applications, the drill bit 150 is rotated by only rotating the drill pipe 122. However, in many other applications, a downhole motor 155 (mud motor) disposed in the drilling assembly 190 also rotates the drill bit 150. The rate of penetration (ROP) for a given BHA largely depends on the weight-on-bit (WOB) or the thrust force on the drill bit 150 and its rotational speed. The mud motor 155 is coupled to the drill bit 150 via a drive shaft disposed in a bearing assembly 157. The mud motor 155 rotates the drill bit 150 when the drilling fluid 131 passes through the mud motor 155 under pressure. The bearing assembly 157, in one aspect, supports the radial and axial forces of the drill bit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided from a program to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The storage device 144 may include any suitable non-transitory storage medium, such as ROM, RAM, EPROM, etc. The surface control unit 140 may further communicate with a remote control unit 148. The surface control unit 140 may process data relating to the drilling operations, data from the sensors and devices on the surface, data received from downhole, and may control one or more operations of the downhole and surface devices.

In addition, the BHA 190 may include a downhole control unit 170. The downhole control unit 170 may include a processor 172 and a storage device 174, which may be a non-transitory storage medium such as solid-state memory, tape or hard disc. The storage device 174 may include one or more computer programs 176 in the storage device 174 that are accessible to the processor 172 for executing instructions contained in such programs. The methods disclosed herein may be performed at the downhole processor 172, the surface processor 142 or in a combination of the downhole processor 172 and the surface processor 142.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, properties or characteristics of the fluids downhole and determine other selected properties of the formation 195 surrounding the drilling assembly 190. Such sensors are generally known in the art and for convenience are generally denoted herein by numeral 165. The drilling assembly 190 may further include a variety of other sensors and devices 159 for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. For convenience, all such sensors are denoted by numeral 159.

The drilling assembly 190 includes a steering apparatus or tool 158 for steering the drill bit 150 along a desired drilling path. In one aspect, the steering apparatus may include a steering unit 160, having a number of force application members 161*a*-161*n*, each such force application unit operated by drive unit or tool made according to one embodiment of the disclosure. A drive unit is used to operate or move each force application member. A variety of wireline tools (not shown) used for logging well parameters subsequent to drilling include formation testing tools that utilize drive units to move a particular device of interest.

In various embodiments, the drilling assembly 190 may include a depth measurement device 188 as disclosed herein for determining a depth traveled by the drill string 120. Additionally, the depth measurement device 188 may be used to measure or determine a rate of penetration of the drill string 120, a build-up rate of a borehole, a hole curvature of a borehole and other parameters related to distances in a borehole. Such measurements may be used with the steering tool 158 to steer the drill string 120 or to alter a steering parameter of the steering tool 158. An imaging device 186 may be positioned uphole or downhole of the depth measurement device 188 to enable determining axial motion by imaging a feature formed on the borehole wall by the depth measurement device 188. For features formed during downhole motion of the drill string 120, the imaging device 186 may be located uphole of the depth measurement device 188. For features formed during uphole motion of the drill string 120, the imaging device 186 may be located downhole of the depth measurement device 188. Imaging of borehole wall features is discussed below with respect to FIG. 4.

Figures 2A, 2B, 2C:
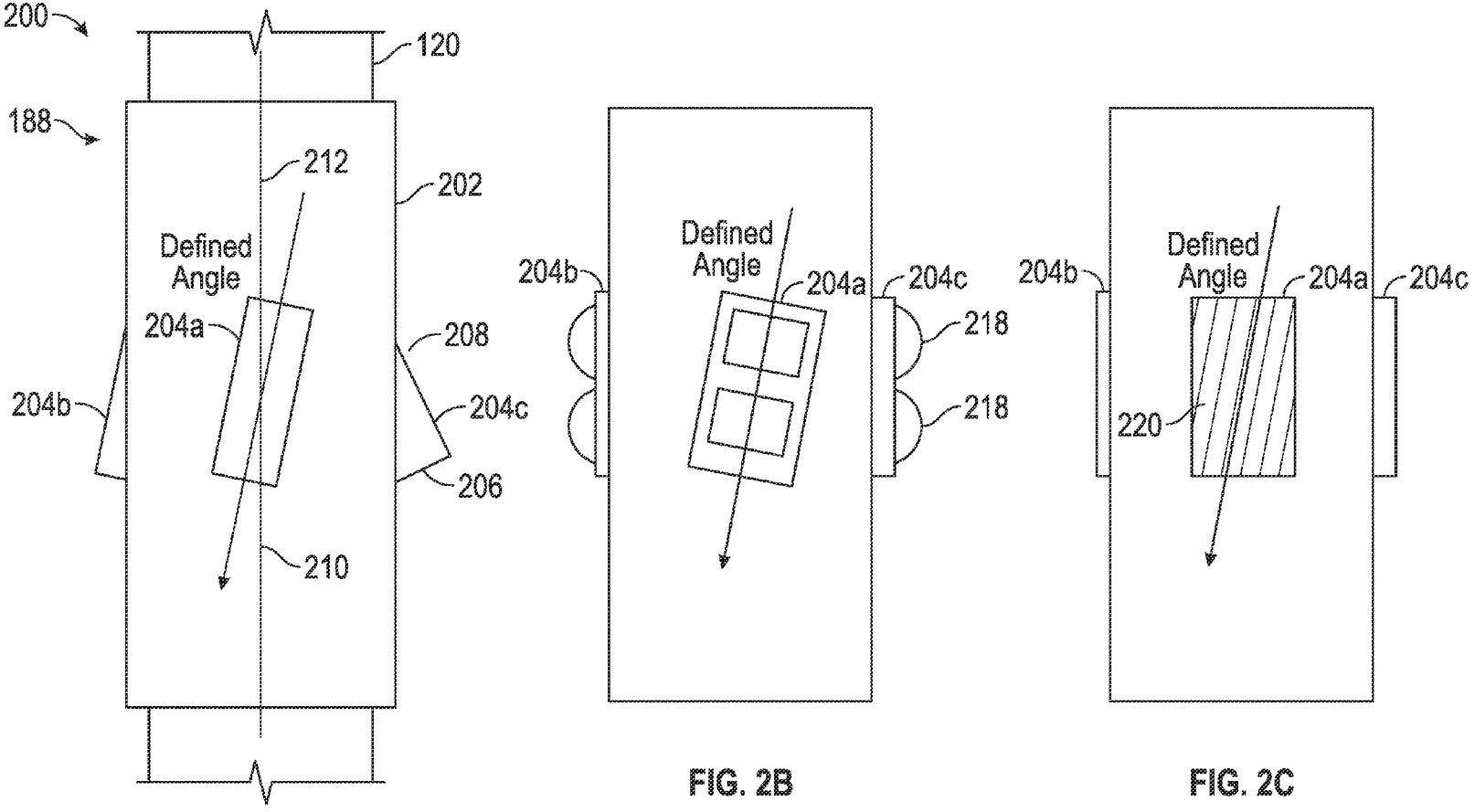
FIG. 2A-2C show examples of sections of the drill string illustrating depth measurement devices for determining a parameter of axial motion using the methods disclosed herein.

Referring now to FIG. 2A, FIG. 2A shows a section 200 of the drill string 120 illustrating an exemplary depth measurement device 188 for determining a depth measurement of the drill string 120 using the methods disclosed herein. A member 202, such as a collar or sleeve, is disposed around the section 200 of the drill string 120. The member 202 is conveyed through the borehole via the drill string 120 and rotates independently or substantially independently of the drill string 120. A set of bearings (not shown) may enable the member 202 to rotate independently or substantially independently of the drill string 120. The member 202 includes expandable elements such as ribs 204*a*, 204*b* and 240*c*. While three elements are shown for illustrative purposes, it is understood that any number of expandable elements may be used in various embodiments. In various embodiments, the expandable elements may be lever-type ribs, a push-type ribs, cantilever-type ribs, ribs including cylinders, ribs including balls, etc. In alternate embodiments, at least one of the elements may be cutters or may include cutting elements, such as a diamond-plated surface, that may be used to cut the formation. Each of the ribs 204*a-c* may be expanded or extended from the member 202 using a suitable actuator (not shown). In various embodiments, the ribs 204*a-c* may be extended from the member 202 using an oil-hydraulic actuator, a mud-hydraulic actuator, an electrical actuator, or other suitable actuators.

In the illustrative embodiment, a selected rib (e.g., rib 204*a*) includes a leading edge 206 and a trailing edge 208. The leading edge 206 may be extended or articulated from the member 202 when the rib 204*a* is expanded. Alternatively, the trailing edge 208 may be extended or both the leading edge 206 and the trailing edge 208 may be extended or any other section or sections along the length of the rib 204*a* may be extended. The rib 204*a* is extended to a radial distance at which it makes contact with a wall of the borehole 126. The rib 204*a* may thus be slidably coupled to the wall of the borehole. A line 210 passing from the trailing edge 208 to the leading edge 206 defines a tilt angle $\alpha$ of rib 204*a*. As the drill string 120 is conveyed through the borehole, the member 202 rotates due to the slidable coupling of the member 202 and the wall 302 of the borehole, and in particular to the slidable coupling of the rib 204*a* and the wall 302 of the borehole. The amount by which the member 202 rotates (i.e., the angle of rotation) is dependent on a tilt angle $\alpha$ of rib 204*a*. The tilt angle $\alpha$ of rib 204*a* may be an angle defined within a plane that is tangential to the member 202 at the location of rib 204*a*. The tilt angle $\alpha$ is defined with respect to an intersection line 212 between the tangential plane and the member 202. In general, the intersection line 212 is substantially parallel to a longitudinal axis of the drill string 120. The tilt angle therefore refers generally to an angle between a longitudinal direction of the borehole and a line defined by contact of a surface of the rib 204*a* with the borehole wall 302. The tilt angle of the rib 204*a* causes the member 202 to rotate with axial motion of the member 202 through the borehole 126. The greater the tilt angle, the greater the rotation of the member 202. The smaller the tilt angle, the smaller the rotation. The tilt angle $\alpha$ may be a fixed angle or an adjustable angle. For the purpose of determining a parameter of axial motion, the tilt angle $\alpha$ is non-zero.

The number and design of the ribs 204*a-c* may vary. In various embodiments, the ribs 204*a-c* may be tilted with sharp edges, tilted with grooves in its surface, tilted with actual cutters or cutting grooves on its surface contacting the formation. Additionally, the ribs 204*a-c* may include cylinders with or without grooves. FIG. 2B shows an embodiment in which the ribs 204*a-c* include cylinders 218 as surface features. In another embodiment, the ribs 204*a-c* are aligned along the drilling direction or any other suitable angle and the surface features 202 of the ribs 204*a-c* may be oriented with respect to the ribs 204*a-c* so as to be directed along the tilt angle. FIG. 2C shows an embodiment of the member 202 in which the ribs 204*a-c* are aligned along the drilling direction The ribs 204*a-c* include surface features 220 which are oriented at a selected title angle. In various embodiments, the angle of the ribs 204*a-c* with respect to the member 202 may be adjustable. Also, the angle of the surface features 220 of the ribs 204*a-c* may be adjustable. The ribs 204*a-c* may be at a fixed tilt angle, a surface-adjusted tilt angle, or at an angle that may be adjusted in real-time or downhole. Hydraulic flow may be provided around the ribs 204*a-c* by having a shape of the ribs 204*a-c* selected for re-directing flow appropriately to counter slippage caused by bearing friction. The shape of the rib 204*a-c* may be a wing shape or a shape that provides less fluid cushion between the borehole wall 302 and the contact surfaces of the ribs 204*a-c*.

Figure 3:
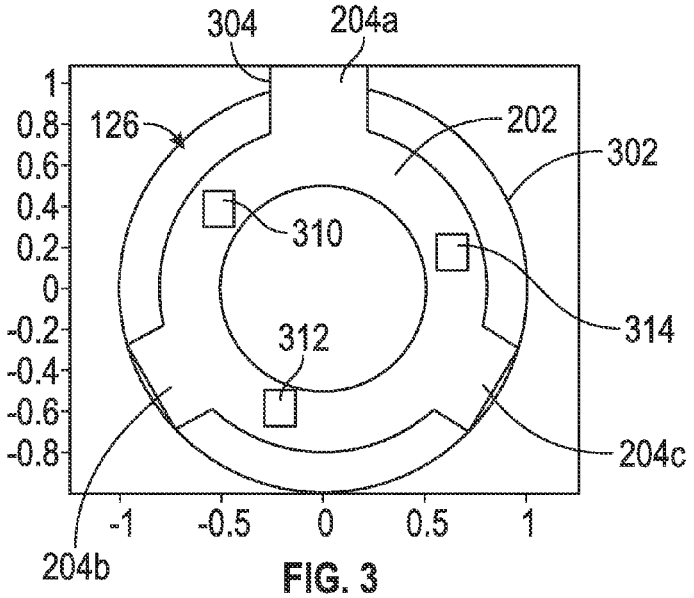
FIG. 3 shows a cross-section of a sleeve of the drill string as viewed looking along a longitudinal axis of the drill string.

FIG. 3 shows a cross-section of the member 202 as viewed looking along a longitudinal axis of the drill string 120. The member 202 includes ribs 204*a*, 204*b* and 204*c* at substantially equidistant locations around the member 202. Ribs 204*b* and 204*c* may be extended to the borehole wall 302 to a first distance in order to provide a suitable support of the member 202 within the borehole 126. Rib 204*a* may be extended to the first distance or further extended or to a second distance greater than the first distance and thus extend into the formation to form a groove 304 in the borehole wall 302 as the drill string 120 and member 202 move along the borehole 126.

As the drill string 120 moves through the borehole 126, extended rib 204*a* is in groove 304 in the wall 302 of the borehole 126 and produces a rotation of the member 202 substantially along the tilt angle $\alpha$ of the rib 204*a*. It is to be understood that, in other embodiments, rotation of the member 202 may be due to frictional forces between the rib 204*a* and the wall 302 of the borehole 126 without forming a groove 304. The amount of rotation of the member 202 is therefore related to the tilt angle $\alpha$ and a distance along the borehole 126 traveled by the member 202 and, by extension, by the drill string 120. Therefore, by measuring or determining the angle of rotation of the member 202, an operator or processor may determine the axial distance traveled by the drill string 120 and/or a rate of penetration (ROP) of the drill string 120. The axial distance and/or ROP may be determined using the downhole processor 172 in various embodiments. It is to be understood that, in other embodiments, more than one rib may be extended to form a groove.

Various methods may be used to determine the angle of rotation of the member 202 as the drill string 120 drills through the formation. In various embodiments, the member 202 may include sensors such as a gravitometer 310, a magnetometer 312, a gyroscope 314, etc., for determining a rotation of the member 202. In another embodiment, the angle of rotation of the member 202 may be measured with respect to the drill string using, for instance, a device on the drill string that measures a relative rotation of the member 202 with respect to the drill string 120.

Figure 4:
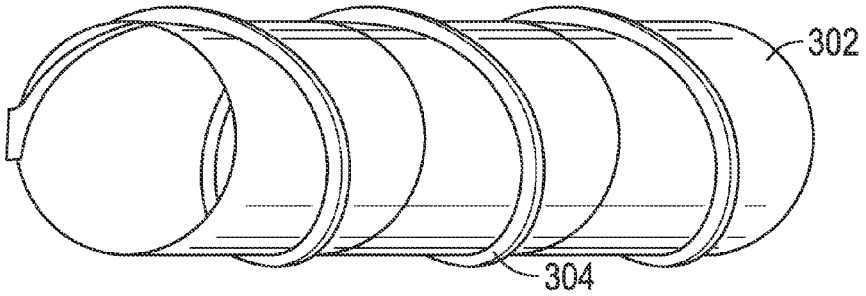
FIG. 4 shows an image of the borehole wall including a feature produced by the sleeve and exemplary expanded rib.

FIG. 4 shows an image of the borehole wall 302 including a feature produced by the member 202 and exemplary expanded rib 204*a* of FIG. 3. As the drill string 120 travels through the borehole 126, the rib 204*a* may form the feature 304 in the borehole wall 302. In particular, the rib 204*a* may form a spiral groove or spiral feature 304 in the borehole wall 302. A helical angle of the spiral feature 304 is related to tilt angle $\alpha$. In one embodiment, the drill string 120 may include an imaging device (186, FIG. 1) uphole of the member 202 for imaging the formation. The imaging device 186 may image or measure the spiral feature 304 in the borehole wall 302, determine the helical angle of the spiral feature 304 and axial distance between the spiral feature 304 and thereby determine a parameter of axial motion, such as a distance traveled (i.e., a measured depth) and/or a rate of penetration (ROP) of the drill string 120, etc. The rate of penetration may be determined from the determined axial distance traveled and a time measurement. In one embodiment, data from the imaging device 186 may be processed at the downhole control unit 170. The distance and/or rate of penetration may therefore be determined in real time. To maintain or improve borehole quality, a reamer may be added behind or uphole of the imaging device 186 to remove the spiral feature formed on the wall of the borehole.

Figure 5:
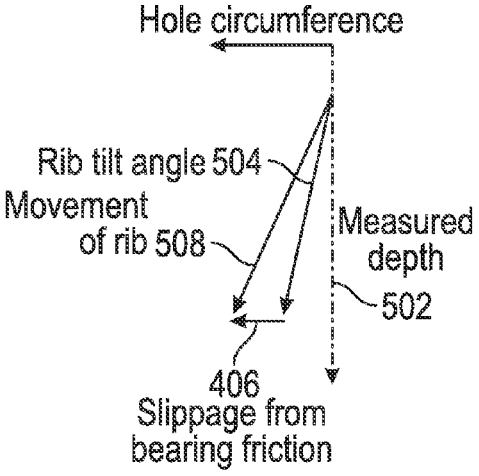
FIG. 5 shows a displacement diagram illustrating an effect of bearing friction on rib movement for a rib at a selected tilt angle.

FIG. 5 shows a displacement diagram illustrating an effect of bearing friction on rib movement for a rib at a selected tilt angle. Vector 502 indicates a hole direction of the drill string 120. The hole direction vector 502 is substantially aligned with a longitudinal axis of the drill string 120. Displacement vector 504 indicates a direction at which the extended rib 204*a* moves with respect to the drilling direction 502, given a selected tilt angle α and without any slippage of the member 202 with respect to the drill string 120. As the drill string 120 moves in the drilling direction 502, the member may slip in a slippage direction 506 due to bearing friction between the member 202 and the drill string 120, hydraulic forces and/or other forces. The resultant displacement vector 508 takes into account member slippage as a sum of the displacement vector 504 the slippage vector 506. One method of reducing the slippage (506) is to create a force between the tilted rib 204*a* and the formation at the borehole wall 302 that is greater than the frictional force between member 202 and the drill string 120.

In another embodiment, rotational slippage may be estimated and then compensated for using various methods. In one embodiment, the rotational slippage may be estimated from rib forces that are detected via hydraulic pressures. The rotational slippage may be determined from a knowledge of properties of the formation (e.g., friction factor, differential sticking parameters), tool wear, mud, related pressures, or the hole cross section (e.g., overgauge, non-round) that are either expected or measured. Additionally, a calculated length determined as the drill string 120 travels over a preselected depth interval (e.g., 100 ft.) may be used to calibrate the estimation of the parameter of axial motion, thereby providing an estimate of the effect of slippage on distance measurement. In one embodiment, the calculated length may be calibrated by sensing when drill string members are being connected (or separated) at the surface between drill string members, since drill string members have a known length.

Figure 6:
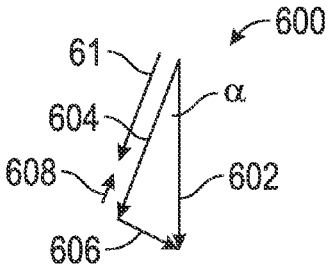
FIG. 6 shows a force diagram indicating forces applied to an exemplary extended rib while drilling a borehole.

FIG. 6 shows a force diagram 600 indicating forces applied to an exemplary extended rib 204*a* while drilling a borehole. Axial force vector $F_{axial}$ 602 indicates a magnitude and direction of a force being applied to the member 202 of the drill string 120. The axial force vector $F_{axial}$ 602 includes a component vector $F_{cutting\ direction}$ 604 along the direction of the rib 204*a*. The angle between the component vector $F_{cutting\ direction}$ 604 and the axial force vector 602 is the tilt angle α. Another component vector, i.e., normal force vector $F_{normal}$ 606, is perpendicular to the component vector $F_{cutting\ direction}$ 604. The normal force vector $F_{normal}$ 606 produces a frictional force $F_{friction}$ 608 that is anti parallel to the component vector $F_{cutting\ direction}$ 604. Thus, the cutting force ($F_{cut}$, 610) with which the rib 204*a* cuts into the formation is governed by the equation:

$$F_{cutting\ direction}=F_{cut}F_{friction} \quad \text{Eq. (1)}$$

The component vector $F_{cutting\ direction}$ 604 is related to the axial force vector $F_{axial}$ 602 by the equation:

$$F_{cutting\ direction}=F_{axial}\cos\alpha \quad \text{Eq. (2)}$$

The frictional force $F_{friction}$ 608 is related to axial force vector $F_{axial}$ 602 by the equation:

$$F_{friction}=\mu F_{axial}\sin\alpha \quad \text{Eq. (3)}$$

where μ is a coefficient of friction. Thus, the resultant cutting force $F_{cut}$ 610 of the rib 204*a* is:

$$F_{cut}=F_{axial}(\cos\alpha-\mu\sin\alpha) \quad \text{Eq. (4)}$$

FIGS. 7 and 8 show tables illustrating estimates of error margins that occur when determining a parameter of axial motion of the drill string using the methods and apparatus disclosed herein. Table 700 of FIG. 7 shows data for a large borehole having a hole diameter (702) of 12.25 inches. The tilt angle (704) is 45 degrees. A percent slippage error (706) is estimated at 4.89%. Table 800 of FIG. 8 shows data for a small borehole having a hole diameter (802) of 4.75 inches. The tilt angle (804) is 30 degrees. A percent slippage error (806) is estimated at 26.26%. Thus, in general, the error in depth measurements increases as the diameter of the borehole decreases.

Thus, in various embodiments, the methods disclosed herein may be used to determine a parameter of axial motion in a borehole such as a measured depth (MD) of the borehole and/or an axial motion of the member indicative, for example, of a rate of penetration (ROP), a tripping speed a reaming speed, off-bottom axial movement, etc. Additionally, the parameter of motion may further include a buildup rate (BUR), a walk rate, a hole curvature, etc. The determined parameter of motion may be used in various aspects of drilling. In one embodiment, the parameter of axial motion may be used to adjust steering, for example, to maintain or alter a drilling parameter or drilling direction. The parameter of axial motion may be determined downhole and thus be used to provide closed loop steering downhole in real time.

In one embodiment, the determined parameter of axial motion is a measured depth or axial distance traveled through the borehole. The measured depth may be used to derive a curvature of a borehole parameter and the derived curvature may then be used to adjust a steering parameter. The derived hole curvature may also be used to adjust a wellpath geometry description of the borehole. In another embodiment, the measured depth may be used to calibrate, for example, logging-while-drilling measurements. In particular, the measured distance may be used to determine a time-to-depth conversion for logging measurements. The measured depth determined using the methods described herein may further be used to evaluate a quality of such measurements. In another embodiment, the measured depth may be used to trigger a depth-related event, such as by-pass valve openings and closings such as may be used for hole cleaning or preparation for a formation testing, pressure testing, forming perforations, etc.

In another embodiment, the determined parameter of axial motion may be the ROP of the drill string. Changes in the determined ROP may be used to identify formation changes. Additionally, changes in the determined ROP may be used to decide on logic for whether to perform by-pass valve actuation or not. Such decisions may thus optimize hole cleaning and/or the RPM of a modular motor. In various embodiments, a quality of the determined ROP may be checked in real-time. Quality checks may consider, for example, rib pressure (which may be indicative of spinning in an over-gauged hole), vibration measurement indicative of operating mode. A low ROP and strong lateral vibration may be correlated to a hard formation and therefore used to determine the presence of a hard formation.

Figure 9:
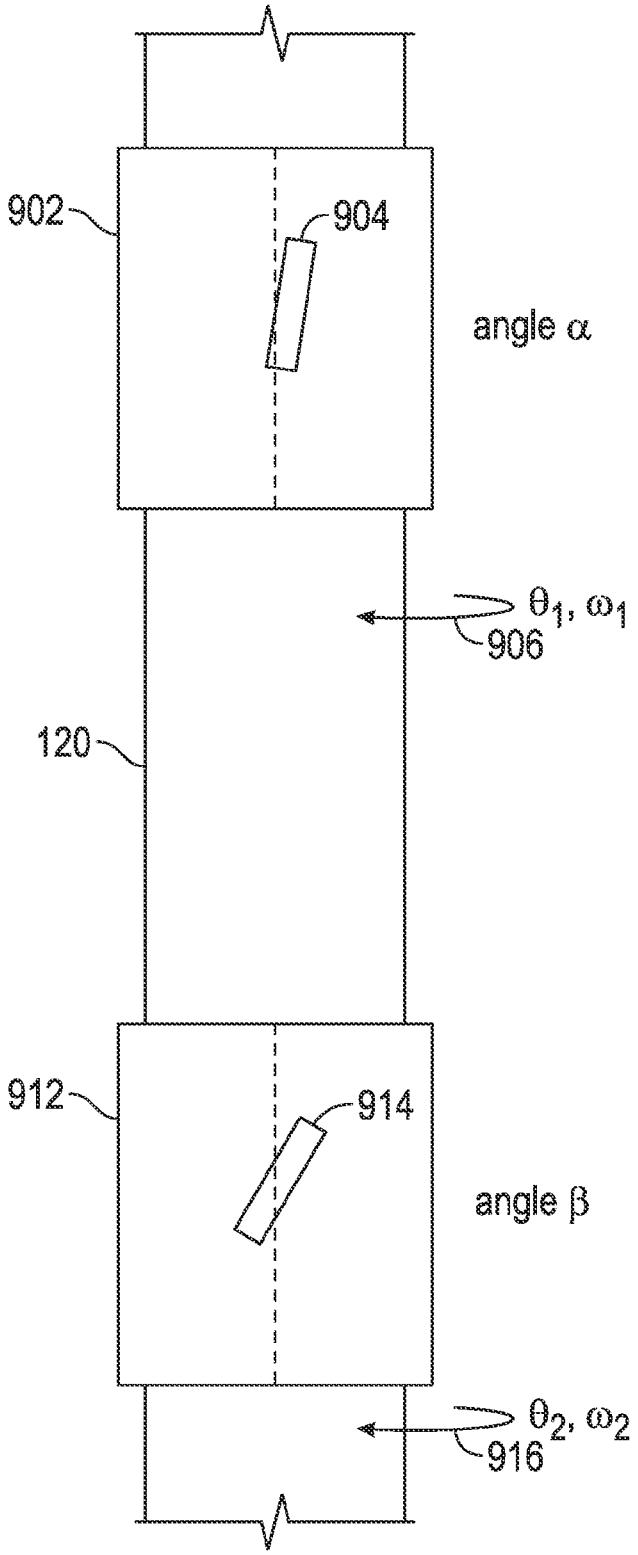
FIG. 9 shows an embodiment in which the parameter of axial motion is determined using a plurality of sleeves.

FIG. 9 shows another embodiment in which the parameter of axial motion is determined using a plurality of independently rotatable member of the drill string. The drill string 120 includes a first member 902 at one axial location of the drill string 120 and a second member 912 at another axial location of the drill string 120. A first rib 904 oriented at a first tilt angle $\alpha$ is extended from the first member 902 and a second rib 914 oriented at a second tilt angle $\beta$ is extended from the second member 912. Thus, the rotation angle $\theta_1$ and rotation speed $\omega_1$ of the first member 902 is generally different than the rotation angle $\theta_2$ and rotation speed $\omega_2$ of the second member 912 as the drill string 120 moves along the borehole. In one embodiment, two tilt angles may be specifically chosen so that $\alpha=-\beta$. The rotation of the first member 902 generates a first measurement of the parameter of axial motion with a first associated error and the rotation of the second member 912 generates a second measurement of the parameter of axial motion with a second associated error. These determined parameters of motion and associated errors may be used to determine an average or intermediate determination of the parameter of motion.

While the methods disclosed herein have been discussed with respect to a measurement-while-drilling system, the methods may be used in a measurement-after-drilling pass, in a completion string, in a milling bottomhole assembly, in a wireline system, or in a pipeline inspection device such as a pig, among other systems.

Therefore, in one aspect the present disclosure provides a method of using a tool in a borehole, including: disposing the tool in the borehole, the tool including a member rotatable substantially independently of the tool; coupling the member to a wall of the borehole; conveying the tool through the borehole to produce a rotation of the member as a result of the coupling between the member and the wall of the borehole; determining a parameter of axial motion of the tool through the borehole from an angle of rotation of the member; and using the tool based on the determined parameter of axial motion. The angle of rotation of the member may be determined by determining a relative rotation of the member with respect to the tool. In various embodiments, determining the angle of rotation of the member further includes measuring the angle of rotation using at least one of: (i) a gravitometer on the member; (ii) a magnetometer on the member; and (iii) a gyroscope on the member. The member may be coupled to the wall of the borehole by extending an element of the member from the member to contact the wall of the borehole, wherein the element couples to the wall of the borehole at a selected tilt angle with respect to a longitudinal axis of the tool. The angle of rotation may result from friction between the element and the wall of the borehole without forming a groove in the wall of the borehole, or from the element forming a groove in the wall of the borehole as the tool is conveyed through the borehole. In various embodiments, the determined parameter of axial motion is corrected for slippage between the member and the borehole wall during rotation of the member. In one embodiment, the member further includes a first member with a first element having a first tilt angle and a second member with a second element having a second tilt angle, further comprising obtaining a first value of the parameter of axial motion and first error measurement of the first parameter of axial motion using the first member and a second value of the parameter of axial motion and second error measurement of the second parameter of axial motion using the second member and obtaining an average value of the parameter of axial motion using the first value of the parameter of axial motion, the second value of the parameter of axial motion, the first error measurement and the second error measurement. In various embodiments, the parameter of axial motion is selected from the group consisting of: (i) a measured depth; (ii) a rate of penetration of the tool; (iii) a rate of reaming a borehole; (iv) a rate of back-reaming a borehole; (v) a rate of tripping; (vi) a rate of a measurement-after-drilling pass; (vii) a build-up rate of the borehole; (viii) a walk rate of the borehole; and (ix) a curvature of the borehole.

In another aspect, the present disclosure provides a system for drilling a formation, including: a drill string; a member of the drill string configured to rotate substantially independently of the drill string, wherein the member is configured to couple to a wall of a borehole in the formation; and a processor configured to: determine an angle of rotation of member produced by coupling of the member to the wall of the borehole as the drill string travels through the borehole, determine a parameter of axial motion of the drill string from the determined angle of rotation, and use the determined parameter of axial motion of the drill string to alter a drilling parameter of the drill string. The system may include a device configured to determine a relative rotation of the member with respect to the drill string to determine the angle of rotation of the member. The member may include at least one of: (i) a gravitometer; (ii) a magnetometer; and (iii) a gyroscope, for determining the angle of rotation of the member. The member may also include an element configured to extend from the member to couple to the wall of the borehole, wherein the element couples to the wall of the borehole at a tilt angle with respect to a longitudinal axis of the tool. The drill string may include an imaging device configured to determine the parameter of axial motion of the drill string from an image of a feature formed at the wall of the borehole by the element. The element may be a rib and/or a cutting device. In one embodiment, the member may include a first member with a first element at a first tilt angle and a second member with a second element at a second tilt angle and the processor is further configured to obtain a first value of the parameter of axial motion and first error measurement of the first parameter of axial motion using the first member and a second value of the parameter of axial motion and second error measurement of the second parameter of axial motion using the second member and determine an average value of the parameter of axial motion using the first value of the parameter of axial motion, the second value of the parameter of axial motion, the first error measurement and the second error measurement. In various embodiment, the parameter of axial motion is selected from the group consisting of: (i) a measured depth; (ii) a rate of penetration of the tool; (iii) a rate of reaming a borehole; (iv) a rate of back-reaming a borehole; (v) a rate of tripping; (vi) a rate of a measurement-after-drilling pass; (vii) a build-up rate of the borehole; (viii) a walk rate of the borehole; and (ix) a curvature of the borehole.

In yet another aspect, the present disclosure provides an apparatus for use in a borehole, the apparatus including: a member configured to be conveyed in a borehole on a tool and to rotate substantially independently of the tool, wherein the member is slidably coupled to a wall of the borehole; and a processor configured to: determine an angle of rotation of the member produced by coupling of the rib with the wall of the borehole and an axial motion of the tool string through the borehole, and determine a parameter of axial motion of the tool string from the determined angle of rotation. The processor may be further configured to determine the angle of rotation of the member using at least one of: (i) a gravitometer on the member; (ii) a magnetometer on the member; and (iii) a gyroscope on the member; (iv) an imaging device imaging a feature formed on the wall of the borehole by the member; and (v) a device for measuring a relative rotation of the member with respect to the tool. The member may include an element configured to extend from the member to couple to the wall of the borehole, wherein the element couples to the wall of the borehole at a tilt angle with respect to a longitudinal axis of the tool. The element may be a rib and/or a cutting device.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

What is claimed is:

1. A method of using a tool in a borehole, comprising:

disposing the tool in the borehole, the tool including a member rotatable independently of the tool;

coupling the member to a wall of the borehole;

conveying the tool through the borehole to produce a rotation of the member as a result of the coupling between the member and the wall of the borehole;

determining a parameter of axial motion of the tool through the borehole from an angle of rotation of the member; and using the tool based on the determined parameter of axial motion.

2. The method of claim 1, wherein determining the angle of rotation of the member further comprises determining a relative rotation of the member with respect to the tool.

3. The method of claim 1, wherein determining the angle of rotation of the member further comprises measuring the angle of rotation using at least one of: (i) a gravitometer on the member; (ii) a magnetometer on the member; and (iii) a gyroscope on the member.

4. The method of claim 1, wherein coupling the member to the wall of the borehole further comprising extending an element from the member to contact the wall of the borehole, wherein the element couples to the wall of the borehole at a selected tilt angle with respect to a longitudinal axis of the tool.

5. The method of claim 4, wherein the angle of rotation is a result of at least one of: (i) friction between the element and the wall of the borehole; and (ii) the element forming a groove in the wall of the borehole as the tool is conveyed through the borehole.

6. The method of claim 1, further comprising correcting the determined parameter of axial motion for slippage between the member and the borehole wall during rotation of the member.

7. The method of claim 1, wherein the member further comprises a first member with a first element having a first tilt angle and a second member with a second element having a second tilt angle, further comprising obtaining a first value of the parameter of axial motion and first error measurement of the first parameter of axial motion using the first member and a second value of the parameter of axial motion and second error measurement of the second parameter of axial motion using the second member and obtaining an average value of the parameter of axial motion using the first value of the parameter of axial motion, the second value of the parameter of axial motion, the first error measurement and the second error measurement.

8. The method of claim 1, wherein the parameter of axial motion is selected from the group consisting of: (i) a measured depth; (ii) a rate of penetration of the tool; (iii) a rate of reaming a borehole; (iv) a rate of back-reaming a borehole; (v) a rate of tripping; (vi) a rate of a measurement-after-drilling pass; (vii) a build-up rate of the borehole; (viii) a walk rate of the borehole; and (ix) a curvature of the borehole.

9. A system for drilling a formation, comprising:

a drill string;

a member of the drill string configured to rotate independently of the drill string, wherein the member is configured to couple to a wall of a borehole in the formation; and a processor configured to:

determine an angle of rotation of the member produced by coupling of the member to the wall of the borehole as the drill string travels through the borehole, determine a parameter of axial motion of the drill string from the determined angle of rotation, and use the determined parameter of axial motion of the drill string to alter a drilling parameter of the drill string.

10. The system of claim 9, further comprising a device configured to determine a relative rotation of the member with respect to the drill string to determine the angle of rotation of the member.

11. The system of claim 9, wherein the member further comprises at least one of: (i) a gravitometer; (ii) a magnetometer; and (iii) a gyroscope for determining the angle of rotation of the member.

12. The system of claim 9, wherein the member includes an element configured to extend from the member to couple to the wall of the borehole, wherein the element couples to the wall of the borehole at a tilt angle with respect to a longitudinal axis of the tool.

13. The system of claim 12, wherein the drill string further comprises an imaging device configured to determine the parameter of axial motion of the drill string from an image of a feature formed at the wall of the borehole by the element.

14. The system of claim 12, wherein the element further comprises at least one: (i) a rib; and (ii) a cutting device.

15. The system of claim 9, wherein the member further comprises a first member with a first element at a first tilt angle and a second member with a second element at a second tilt angle and the processor is further configured to obtain a first value of the parameter of axial motion and first error measurement of the first parameter of axial motion using the first member and a second value of the parameter of axial motion and second error measurement of the second parameter of axial motion using the second member and determine an average value of the parameter of axial motion using the first value of the parameter of axial motion, the second value of the parameter of axial motion, the first error measurement and the second error measurement.

16. The system of claim 9, wherein the parameter of axial motion is selected from the group consisting of: (i) a measured depth; (ii) a rate of penetration of the tool; (iii) a rate of reaming a borehole; (iv) a rate of back-reaming a borehole; (v) a rate of tripping; (vi) a rate of a measurement-after-drilling pass; (vii) a build-up rate of the borehole; (viii) a walk rate of the borehole; and (ix) a curvature of the borehole.

17. An apparatus for use in a borehole, comprising:

a member configured to be conveyed in the borehole on a tool and to rotate independently of the tool, wherein the member is slidably coupled to a wall of the borehole; and a processor configured to:

determine an angle of rotation of the member produced by coupling of the rib with the wall of the borehole and an axial motion of the tool string through the borehole, and determine a parameter of axial motion of the tool string from the determined angle of rotation.

18. The apparatus of claim 17, wherein the processor is further configured to determine the angle of rotation of the member using at least one of: (i) a gravitometer on the member; (ii) a magnetometer on the member; (iii) a gyroscope on the member; (iv) an imaging device imaging a feature formed on the wall of the borehole by the member; and (v) a device for measuring a relative rotation of the member with respect to the tool.

19. The apparatus of claim 17, wherein the member includes an element configured to extend from the member to couple to the wall of the borehole, wherein the element couples to the wall of the borehole at a selected tilt angle with respect to a longitudinal axis of the tool.

20. The apparatus of claim 17, wherein the element further comprises at least one: (i) a rib; and (ii) a cutting device.

* * * * *